United States Patent [19]

Tiefenthal

[11] 4,353,562

[45] Oct. 12, 1982

[54] ICE SKATE

[76] Inventor: Alfred Tiefenthal, Grenzstrasse 47j, 4220 Dinslaken, Fed. Rep. of Germany

[21] Appl. No.: 182,321

[22] Filed: Aug. 28, 1980

[30] Foreign Application Priority Data

Jul. 5, 1980 [DE] Fed. Rep. of Germany ... 8018079[U]

[51] Int. Cl.[3] ..... A63C 17/18

[52] U.S. Cl. ..... 280/7.13; 280/11.18

[58] Field of Search ..... 280/7.13, 7.12, 7.14, 280/8, 11.19, 11.12, 11.27, 11.28, 11.3, 11.2, 11.18

[56] References Cited

U.S. PATENT DOCUMENTS

| | | | |
|---|---|---|---|
| 1,094,434 | 4/1914 | Golden | 280/11.3 |
| 1,181,831 | 5/1916 | Browne | 280/11.18 |
| 1,243,077 | 10/1917 | Kuchtik | 280/7.13 |
| 1,256,564 | 2/1918 | Hunold | 280/11.3 |
| 2,874,970 | 2/1959 | Mall | 280/7.13 |
| 2,985,461 | 5/1961 | Lynn et al. | 280/7.13 |
| 3,180,651 | 4/1965 | Ware | 280/11.2 |

FOREIGN PATENT DOCUMENTS

| | | | |
|---|---|---|---|
| 2328256 | 1/1975 | Fed. Rep. of Germany | 280/7.13 |

*Primary Examiner*—David M. Mitchell
*Attorney, Agent, or Firm*—Michael J. Striker

[57] ABSTRACT

An ice skate has a blade and a shoe support formed with three downwardly directed extensions spaced from each other along the length of the blade. The blade of the ice skate is formed with a first projection formed at the front end thereof and extending towards the shoe support and a second projection extending towards the shoe support and located in the middle of the blade in the lengthwise direction. These projections are provided with respective plates adapted to be secured to the shoe support by means of screws extending into the holes formed in the shoe support. Such structure of the ice skate blade permits one to utilize the similar shoe support for the ice skates and roller skates.

8 Claims, 3 Drawing Figures

ICE SKATE

BACKGROUND OF THE INVENTION

The present invention relates to ice skates and more particularly to a mounting arrangement for connecting a blade to a shoe support adapted to be attached to a shoe of a user.

There are known in the prior art shoe supports utilized for roller skates and normally made of light metals or any other suitable materials.

These shoe supports are normally secured to roller supporting means by three screws.

It has been observed that it would be desirable to utilize a shoe support adapted for use in the roller skates for the ice skates. The prior art arrangements are, however, incapable to resolve this problem by relatively simple means.

SUMMARY OF THE INVENTION

It is therefore an object of this invention to provide an improved construction of an ice skate where a shoe support previously utilized for the roller skates may be adequately used.

Another object of the invention is to provide an ice skate which is rather inexpensive and has a shoe support constructed so that it may be easily adapted for either roller skates or ice skates.

These and other objects of the invention are attained by an ice skate comprising a shoe support adapted to be attached to a shoe of a user, an elongated blade and means for connecting the blade to the shoe support. The blade is formed with a first projection extending towards said support and positioned at the front end of the blade and a second projection extending towards the shoe support and located substantially in the middle of the blade. The connecting means include a first plate secured to the first projection and rigidly connected to the shoe support and a second plate secured to the second projection and rigidly connected to the shoe support.

The first projection of the blade may be inclined toward the middle of said blade.

The first plate may be a metallic plate and have a portion connected to said first projection by means of hard soldering.

The first plate may be connected to the shoe support by a screw.

The shoe support may have a first downwardly directed extension, said first plate abutting against the surface of said first extension when the first plate is connected to the shoe support.

The first plate may be circular.

The second plate may be metallic and may include a central portion rigidly connected to the second projection of the blade and two outwardly extending lateral projections.

The central portion may be connected to the second projection of the blade by means of hard soldering.

The shoe support may further include a second downwardly directed extension and a third downwardly directed extension, said lateral portions of said second plate being arranged so as to overlap the second and third extensions, respectively, to be connected thereto.

Two screws may be produced in the construction to connect said extensions to the second plate and each of said extensions may be formed with a tapped hole to receive the respective one of said screws.

The lateral portions of the second plate may be upwardly inclined.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
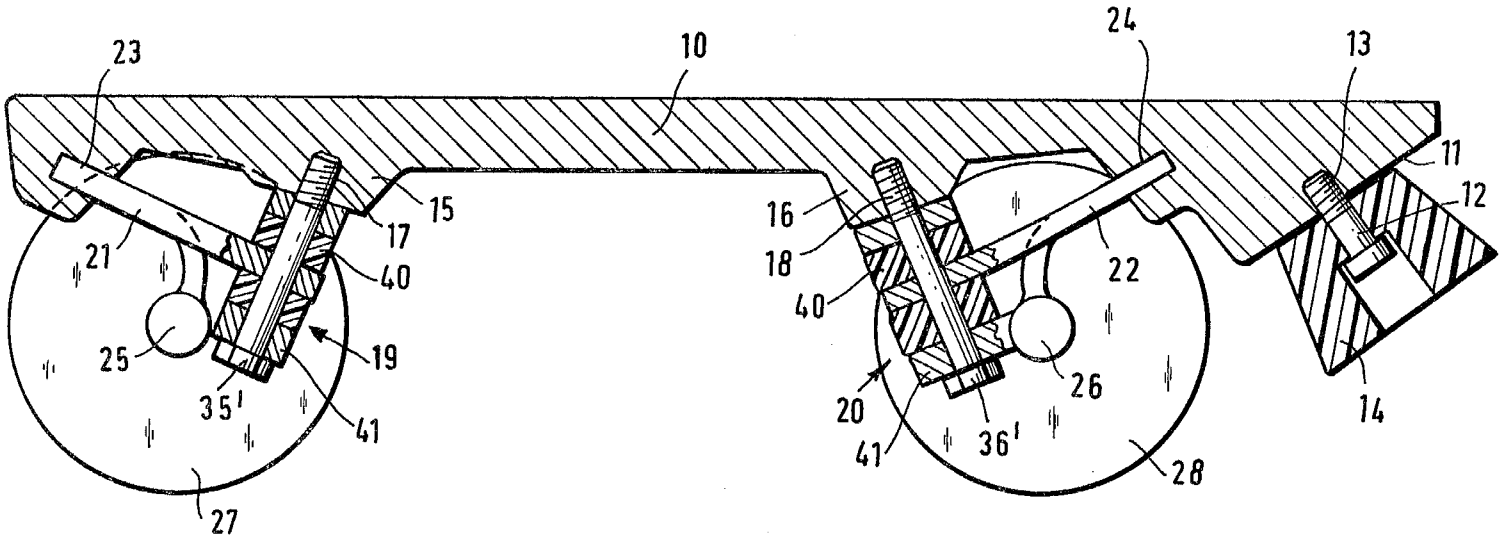
FIG.1 Prior Art
FIG. 1 illustrates a sectional view of a shoe support of the conventional type for use in a roller skate.

Referring first to FIG. 1 illustrating a prior art shoe support utilized for a roller skate, a shoe support 10 is an elongated frame normally shaped to fit the sole of a shoe of a user. A sloped surface 11 is provided at the front end of the support 10. A stopper 14 made of rubber or any other suitable material is attached to the surface 11 by means of a screw 12 extending into a tapped hole 13 formed in the shoe support 10. The shoe support is formed with two downwardly extended projections 15 and 16 spaced from each other in the lengthwise direction. Each of the projections 15 and 16 is formed with a tapped hole 17 and 18, respectively to receive the respective threaded portions of screws 35' and 36'. To support rollers 27 and 28 supporting arrangements 19 and 20 are respectively provided in the construction of the roller skate. Each supporting arrangement 19 or 20 includes intermediate elements 40 preferably made of rubber embracing an arm 21 or 22, respectively. These arms extend angularly toward the underside of the shoe support and have the respective ends received in recesses 23 or 24 provided in the shoe support 10. The arms 21 and 22 each carries a corresponding axle 25 or 26 carrying the roller 27 or 28 made of special material such as synthetic resin. In assembly, the lower end of arm 21 or 22 is clamped between the intermediate elements 40 and washers 41 by means of bolts 35' or 36' threaded to the underside of the support 10.

Figure 2:
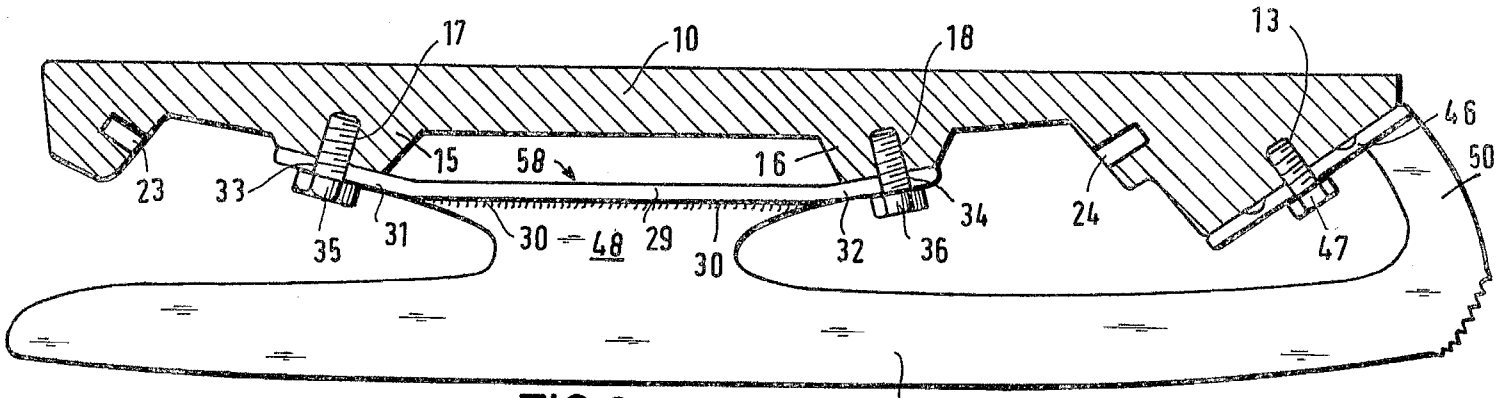
FIG. 2 shows a side view, partially in section, of an ice skate according to the invention.
Figure 3:
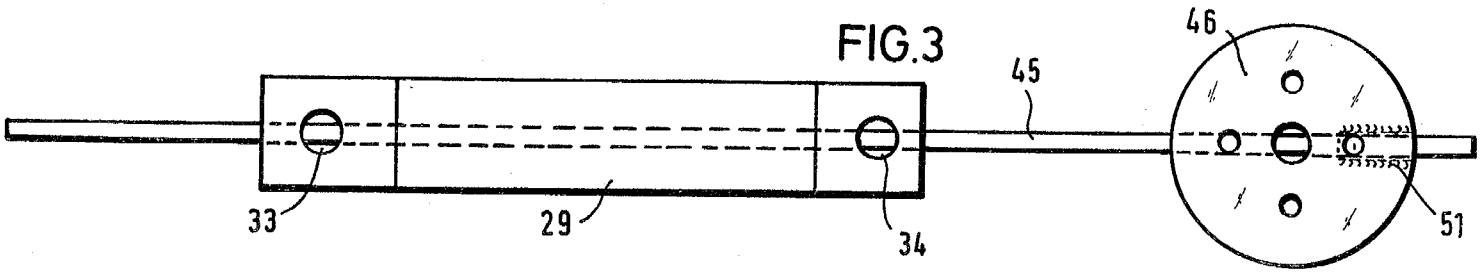
FIG. 3 is a plan top view of a blade removed from the shoe support shown in FIG. 2.

As may be seen in FIG. 2 showing a side view of an ice skate according to the invention, the shoe support or base 10 has the structure and characteristics analogous to those illustrated and described for FIG. 1. The tapped holes 13, 17 and 18 are provided in the base 10. The recesses 23 and 24 are also formed in the base or shoe support 10 at the same locations as for the shoe support utilized for a roller skate. These recesses, however are not used in the structure provided for an ice skate. The ice skate shown in FIG. 2 includes a blade 45 which is formed with a sloped portion 50 at the front end thereof. This portion is inclined towards the shoe support 10 and is provided with a circular plate 46 rigidly secured thereto, for example by means of hard soldering denoted as 51 in FIG. 3. The plate 46 may have any other suitable shape which should fit the bottom surface 11 to which plate 26 is to be attached. A screw 47 is provided in the ice skate to secure plate 46 to the shoe support 10 which extends into the same tapped hole 13 provided for the shoe support utilized for the roller skate.

The blade 45 is formed with an upwardly extended projection 48 located approximately in the middle of the elongated blade. A metal strip 58 having a central portion 29 rigidly connected to the projection 48 and two upwardly extending sloped portions 31 and 32 is mounted on the blade. The central portion 29 may be joined to the projection 48 by means of hard soldering indicated by 30 in the drawing. The portions 31 and 32 overlap the surfaces of the respective projections 15 and 16 and are connected thereto by means of screws 35 and 36 which extend into the tapped holes 17 and 18, respectively so that the blade 25 is secured to the shoe support 10 through the metal strip 25 and screws 35 and 36. Screws 35 and 36 utilized for an ice skate are substantially shorter than screws 35' and 36' used for securing the rollers on the shoe support of the roller skate shown in FIG. 1. The screw 27 may preferably have a hexagonal head.

It will be understood that each of the elements described above, or two or more together, may also find a useful application in other types of constructions differing from the types described above.

While the invention has been illustrated and described as embodied in a an ice skate it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An ice skate, comprising a shoe support adapted to be attached to a shoe of a user; an elongated blade having a front end, said blade being formed with only two upward projections a first projection positioned at said front end and inclined rearwardly towards said support and a second projection extending towards said support and located substantially in the middle of the blade; and connection means for connecting the blade to the shoe support, including a first metallic plate rigidly connected to said first projection and inclined towards the middle of the blade, said first plate being connected to said support by means of at least one screw, and a second metallic plate having a central portion rigidly connected to said second projection and two lateral portions outwardly extending from said central portion in a direction of elongation of the blade, each of said lateral portions being connected to said support by at least one screw.

2. The ice skate of claim 1, wherein said first plate is connected to said first projection by means of hard soldering.

3. The ice skate of claim 2, wherein said shoe support has a first downwardly directed extension, said first plate abuts against the surface of said first extension when said first plate is connected to said shoe support.

4. The ice skate of claim 3, wherein said first plate is circular.

5. The ice skate of claim 4, wherein said central portion is connected to said second projection by means of hard soldering.

6. The ice skate of claim 5, wherein said shoe support further includes a second downwardly directed extension and a third downwardly directed extension, said lateral portions of said second plate arranged to overlap said second and third extensions, respectively, to be connected thereto.

7. The ice skate of claim 6, each said second and third extensions of said shoe support being provided with a tapped hole to receive the respective one of said screws.

8. The ice skate of claim 7, wherein said lateral portions are upwardly inclined.

* * * * *